US008499999B2

(12) United States Patent
Sieber et al.

(10) Patent No.: US 8,499,999 B2
(45) Date of Patent: Aug. 6, 2013

(54) FOLDING BOX WITH INNER CHAMBER

(75) Inventors: Helmut Sieber, Heidenheim (DE); Rolf Nemec, Gerstetten (DE)

(73) Assignee: Carl Edelmann GmbH (DE)

( * ) Notice: Subject to any disclaimer, the term of this patent is extended or adjusted under 35 U.S.C. 154(b) by 325 days.

(21) Appl. No.: 12/862,257

(22) Filed: Aug. 24, 2010

(65) Prior Publication Data

US 2011/0057024 A1 Mar. 10, 2011

(30) Foreign Application Priority Data

Sep. 9, 2009 (EP) ..... 09169811

(51) Int. Cl.
*B65D 5/486* (2006.01)
*B65D 25/54* (2006.01)

(52) U.S. Cl.
USPC .... 229/120.18; 206/775; 206/784; 229/162.1

(58) Field of Classification Search
USPC ..... 229/120.08, 120.11, 120.18, 185.1, 229/162.1; 206/525, 775, 776, 777, 778, 206/779, 784, 769
See application file for complete search history.

(56) References Cited

U.S. PATENT DOCUMENTS 3,115,290 A * 12/1963 Byassee ..... 229/120.18
3,385,502 A * 5/1968 Pilger ..... 206/784
3,424,299 A * 1/1969 Rosenburg, Jr. ..... 206/763
3,672,559 A * 6/1972 Webinger ..... 206/784
3,680,687 A 8/1972 D'Alessio
4,264,006 A * 4/1981 Swanberg ..... 206/783
4,385,687 A * 5/1983 Dutcher ..... 206/779
4,388,999 A * 6/1983 Berry et al. ..... 229/185.1
5,005,701 A * 4/1991 Dutcher ..... 206/775
5,413,274 A * 5/1995 Forbes, Jr. ..... 229/162.1

(Continued)

FOREIGN PATENT DOCUMENTS

DE 9319217 U1 2/1994
DE 20016959 U1 12/2000

(Continued)

*Primary Examiner* — Gary Elkins
(74) *Attorney, Agent, or Firm* — Jansson Munger McKinley & Shape Ltd.

(57) ABSTRACT

A folding box for the storage and presentation of products is provided, which includes an outer packaging body with a front wall, a rear wall, at least two side walls, a top element, and a bottom element, and which also includes a hollow inner chamber with a polygonal cross section in the interior of the outer packaging body. The inner chamber is formed by a front wall element, a rear wall element, and two side wall elements, and holds a product securely in the folded-open state of the folding box. The folding box is formed from a one-piece blank, and the outer packaging body and the inner chamber are glued to each other, providing the width of the inner chamber being less than the width of the outer packaging body, such that, between at least one side wall in the interior of the outer packaging body and at least one side wall element of the inner chamber, an empty space is formed. At least part of only one of the outer surfaces of the inner chamber elements, namely, either part of the front wall element or part of the one of the two side wall elements, is glued to only one of the inner surfaces of the outer packaging body. The inner chamber is formed by folding the front wall element, the rear wall element, and the side wall elements toward the outer side of the blank.

8 Claims, 3 Drawing Sheets

U.S. PATENT DOCUMENTS

| | | | | |
|---|---|---|---|---|
| 5,465,834 | A * | 11/1995 | Sieber et al. | 229/120.18 |
| 6,012,630 | A | 1/2000 | Block | |
| 2004/0011859 | A1 * | 1/2004 | Lo Duca | 229/120.18 |
| 2005/0000854 | A1 * | 1/2005 | Madigan | 206/776 |

FOREIGN PATENT DOCUMENTS

| | | | |
|---|---|---|---|
| EP | 1477412 | A1 | 11/2004 |
| FR | 2749825 | A1 | 12/1997 |
| FR | 2853884 | A1 | 10/2004 |

* cited by examiner

FOLDING BOX WITH INNER CHAMBER

CROSS REFERENCE TO RELATED APPLICATION

This application claims priority based on European patent application EP 09 169 811.8, filed Sep. 9, 2009.

FIELD OF INVENTION

The present invention pertains to a folding box for the storage and presentation of products with an outer packaging body, inside of which is a hollow inner chamber, in which a product is securely held in the closed state of the folding box. In particular, the invention pertains to a folding box as described above in which the inner chamber can be positioned in various positions and configurations inside the outer packaging body.

BACKGROUND OF THE INVENTION

Folding boxes of the type described above with inner chambers or cavity walls are known. One example is found in DE 200 16 959 U1. In the volumes created by the inner chambers or cavity walls, products of any desired shape, usually products of high value such as cosmetics, medications, or food products, are presented in an attractive manner and at the same time are kept securely in the folding box.

So that these types of folding boxes can be pre-fabricated and then folded open, the cavity walls or hollow chambers lying inside a folding box must be firmly connected to the outer packaging body. For this purpose, the inner components must be glued permanently to the inside surfaces of the outer packaging body and thus held securely in place. When flat surfaces of cardboard material are to be glued together, there are certain limitations on the design of the box to guarantee that a secure bond is obtained and also to ensure that, after the gluing process, no glue is squeezed out from between the glued surfaces. For example, a surface to be glued should comprise a certain minimum area, which, according to the current state of the art, is 8 mm in both width and length. For folding boxes, this means that the glue tabs must comprise a minimum width of 8 mm so that a sufficient amount of glue can be applied, but not so much that it will be squeezed beyond the surface to be glued under the effect of pressure.

Another boundary condition for cavity walls arranged in the interior of a folding box is that the only way in which a clean 90° fold can be obtained when the box is folded open is if the width of the cavity wall along the fold line is greater than 8 mm.

Typically, folding box manufacturers print one side of the folding boxes for products, cut them out, stamp them, fold them, and glue them in such a way that, out of the flat folding box blank, a semi-finished folding box, also flat, is obtained. These semi-finished folding boxes are delivered in flat, stacked form to the product manufacturer, where they are partly unfolded to form the cuboid shape. The product to be packaged can now be introduced into the folding box, which is then closed and thus assumes its final state.

There are certain required minimum dimensions and minimum spacings for the hollow chambers or cavity walls in the interior of folding boxes. As a result of the design-related requirements described above, it has not previously been possible to position inner chambers or cavity walls inside an outer packaging body where the side walls of the inner chamber are not glued directly to the side walls of the outer packaging body. In addition, it has not previously been possible to position inner chambers or cavity walls a distance from the side walls of the outer packaging body less than the previously mentioned minimum distance of 8 mm required for gluing.

In the finished state, the product in the inner chamber should be presented in attractive surroundings without the need for additional processing or finishing steps.

OBJECTS OF THE INVENTION

It is therefore the object of the present invention to provide a folding box with an inner chamber, wherein the inner chamber can be positioned variably anywhere inside the internal volume of the outer packaging body without minimum distances. In addition, it is desirable to provide a folding box with such an inner chamber where only a minimum amount of gluing surface is required, and where a product present in the inner chamber is stored and held in visually attractive surroundings.

These and other objects of the invention will be apparent from the following descriptions and from the drawings.

SUMMARY OF THE INVENTION

According to the invention, the folding box for storing and presenting products includes an outer packaging body with a front wall, a rear wall, at least two side walls, a top element, a bottom element, and a hollow interior chamber with a rectangular cross section arranged in the interior of the outer packaging body. The interior chamber is formed by a front wall element, a rear wall element, and two side wall elements, in which chamber a product, in the closed state of the folding box, is securely held. The folding box is formed from a one-piece blank, which includes an outer side and an inner side, and wherein the outer packaging body and the inner chamber are glued to each other. The width of the inner chamber is less than the width of the outer packaging body with the result that, between at least one side wall in the interior of the outer packaging body and at least one side wall element of the inner chamber, an empty space is formed. At least part of only one of the outer surfaces of the inner chamber elements, namely either part of the front wall element or part of one of the two side wall elements, is glued to only one of the inner surfaces of the outer packaging body. The inner chamber is formed by folding the front wall element, the rear wall element, and the side wall elements toward the outer side of the blank, in contrast to the outer packaging body which is in principle formed by folding the respective elements towards the inner side of the blank.

As a result of the flexibility with which the empty space can be arranged between the side walls of the outer packaging body and the side wall surfaces of the inner chamber, the inner chamber can be positioned variably within the outer packaging body. In particular, the designer therefore becomes independent of the minimum distances imposed by the requirements of effective gluing. The folding of the inner chamber elements toward the printed, visually attractive outer surface of the blank has the effect that the product is held inside the chamber in such a way that the printed side of the blank surrounds the product and is therefore visible from the outside through an opening or window possibly provided in the inner chamber.

The outer packaging body preferably comprises a rectangular or polygonal cross section. In the case of a rectangular cross section, the wall elements of the outer packaging body will face the corresponding wall elements of the inner chamber. This is not a mandatory condition, however, for folding boxes with a polygonal cross section. As may be appreciated by those skilled in the art, various other shapes including hexagonal, octagonal and the like can also be used as outer packaging bodies.

It is advantageous to form a retaining tab on the rear wall element of the inner chamber; this tab can be glued to the front wall element in such a way that, in the folded-open state, a retaining web extending through the inner chamber is formed. This retaining web guarantees that, if the cross section of the bottom end of the product in the inner chamber is larger than one of the two cross-sectional surfaces created by the division of the inner chamber by the retaining web, the product cannot slip out of inner chamber, because it is held by the retaining web, which thus functions as a stop.

It is also advantageous for the front wall element of the inner chamber to comprise a first opening. This opening can cover a certain part of the front wall of the inner chamber and makes it possible for the product present within the inner chamber to be visible from outside the inner chamber.

Together with a second opening, which is advantageously located in the front wall of the outer packaging body and preferably at least part of which, in the folded-open state, lies over the first opening, it is also possible to see part of the product present in the inner chamber from outside the outer packaging body. Because the inner surface of the front wall of the outer packaging body and the outer surface of the front wall element of the inner chamber do not necessarily have to be glued to each other, it is quite possible for a gap to be present between the first opening and the second opening. As a result of such a gap, the product can be presented in the folding box in a visually attractive manner. The two openings do not necessarily have to remain open. Particularly, depending on the product, transparent film, colored film or other decorative packaging materials, can be glued, fixed or otherwise attached over each presented product.

A tab is preferably formed on at least one side wall of the outer packaging body. The tab comprises three parallel fold lines, such that, after the folding box has been folded, the tab is folded in such a way that at least part of the free end of the tab can be glued to the inner surface of the side wall. As a result of such folding, a cuboid-shaped cavity is formed which cooperates with the inner chamber in such a way that a product present in the inner chamber is securely held therein. The cavity formed by folding the tab can be flipped back in parallelogram fashion similar to a cover flap after the folding box has been opened. Such is accomplished, in the interior of the outer packaging body, by the inner chamber providing a corresponding free space, into which the cuboid-shaped cavity can be folded. It is also self-evident that the retaining surface of the cuboid-shaped cavity and the rectangular cross-sectional opening of the inner chamber overlap or face each other in the closed state of the folding box. Such overlapped positioning provides a space that prevents the product present in the inner chamber from falling out.

The empty space between a side wall of the outer packaging body and a side wall surface of the inner chamber is preferably less than 8 mm. It is thus possible for the inner chamber to be very close to the side wall of the outer packaging body.

BRIEF DESCRIPTION OF THE DRAWINGS

In order that the advantages of the invention will be readily understood, a more detailed description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF PREFERRED EMBODIMENTS

Figure 1:
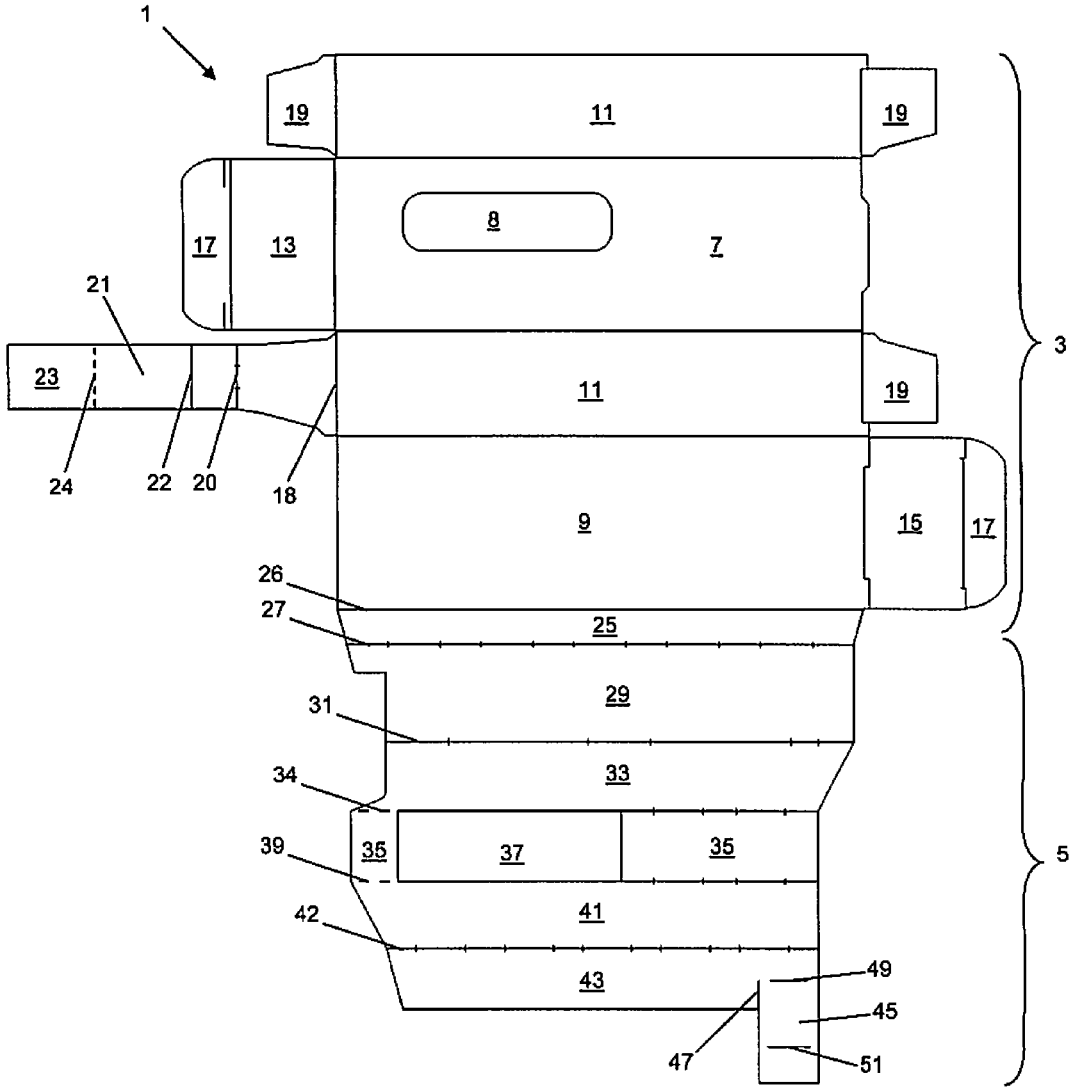
FIG. 1 shows a flat cardboard blank of a folding box according to a preferred embodiment of the invention.
Figure 2:
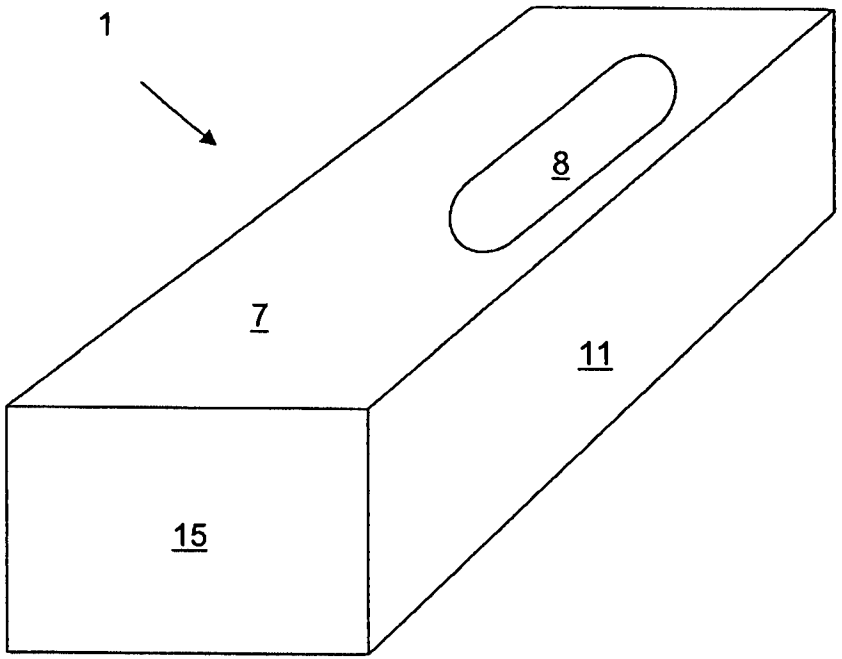
FIG. 2 shows a perspective view of the folded box made from the cardboard blank of FIG. 1 in its constructed state which has been formed by folding the one-piece blank shown in FIG. 1.
Figure 3:
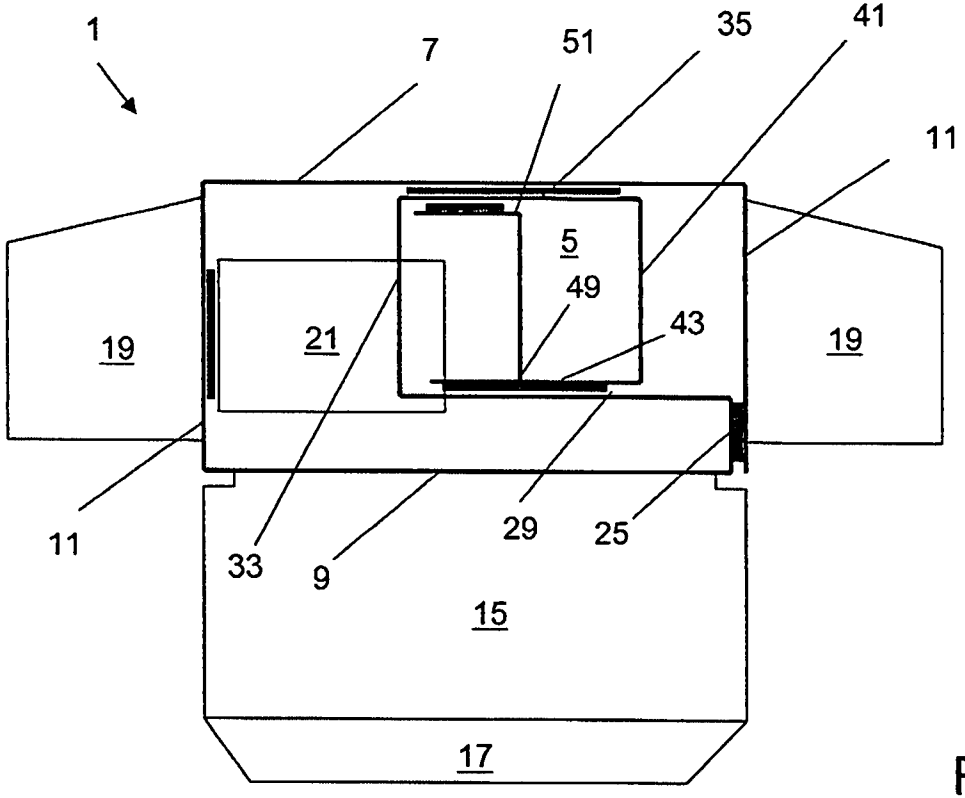
FIG. 3 is a section of the folding box of FIG. 2 showing inner chamber 5 formed by folding the one-piece blank of FIG. 1.

FIG. 1 shows the flat cardboard blank 1 of a preferred embodiment of an inventive folding box, wherein both the outer packaging body and the inner chamber comprise a rectangular cross section. FIG. 2 shows the folded box in its constructed state which has been formed by folding the one-piece blank 1 shown in FIG. 1. FIG. 3 is a section of the folding box in FIG. 2 showing how the inner chamber 5 is formed by folding the one-piece blank 1 of FIG. 1. The blank 1 consists generally of the components of the outer packaging body 3 and the components of the inner chamber 5. The components of the outer packaging body 3 with a rectangular cross section comprise a front wall 7, a rear wall 9, and two side walls 11, having a top element 13 and a bottom element 15 arranged on opposite ends of front wall 7 and rear wall 9, respectively. At the free ends of top element 13 and of bottom element 15, there are in each case an insertion tab 17 of the known type, which functions during the opening and closing of the folding box. Closing tabs 19 on the transverse sides of side walls 11 complete the outer packaging body 3 in the known manner.

In addition to the rectangular cross section of the outer packaging body used in the preferred embodiment, it is also possible to use other cross sections, including a polygonal cross section including a hexagonal cross section, octagonal cross section and the like. It is also conceivable that the cross section could change over the length of the outer packaging body.

In another preferred embodiment, the side wall lying between front wall 7 and rear wall 9 comprises a tab 21 at the top end of the folding box, which tab comprises three fold lines 20, 22, 24 and thus has a free end 23. The function of tab 21 will be explained in detail below. The exact design of the cuts and fold lines of outer packaging body 3 will not be described here, because they are generally known to one skilled in the art.

At the "end", i.e. one edge of the outer packaging body 3, a glue tab 25 is arranged on the long side of the rear wall 9 along a fold line 26. Glue tab 25 marks the transition between the outer packaging body 3 and the inner chamber 5. By way of a fold line 27, a rear wall element 29 is formed on the glue tab 25. The other long side of this rear wall element is connected by way of fold line 31 to a first side wall element 33. The front wall element 35 is connected to the first side wall element 33 by way of fold line 34, wherein, in the exemplary embodiment shown here, front wall element 35 is interrupted by a first opening 37. Connected to front wall element 35 by way of fold line 39 is a second side wall element 41, and connected to that by way of fold line 42 is an additional rear wall element 43. On the short side facing the bottom, rear wall element 43 comprises a retaining tab 45, wherein, at the transition between rear wall element 43 and retaining tab 45, a cut 47 is formed. Retaining element tab 45 includes two fold lines 49 and 51, wherein cut 47 extends essentially to the level of fold line 49.

In a preferred embodiment of the folding box of the present invention, blank 1 of the folding box comprises an inner side and an outer side, wherein the inner side is visible in FIG. 1.

The outer side, which is visible in the present exemplary embodiment in FIG. 3, is usually given special treatment, e.g., covered attractively by color printing, ornamentation and the like, and therefore comprises physical parameters different from those present on the inside surface, which is given little or no treatment.

First it should be observed that the components of inner chamber 5, starting from fold line 27, are folded along fold lines 31, 34, 39, 42 oppositely to the direction in which the elements of outer packaging body 3 are folded, i.e. the inner chamber elements are folded down from the plane of the drawing, the outer body elements are folded up from the plane. Because a folding box for products generally comprises a smooth surface which has been designed and prepared for optimal printing and because the inner surface facing the interior of the folding box is not typically specially treated or finished, the fold lines must be prepared differently, depending on the folding direction. In the exemplary embodiments shown, fold lines 27, 31, 34, 39, and 42 are prepared by providing cuts in certain areas in such a way that creasing along the fold line leads to a clearly defined and irreversible fold. Specifically, bending by 90° at the fold lines cause much less material stress than that which would be produced with fold lines without a series of cuts. The preparation of the fold lines as combinations of scores and cuts is also necessary for the reason that, when the folding box is folded open from the pre-fabricated flat state, clearly defined angles, preferably right angles if possible, must be formed before filling the box with a product. Accordingly, after the box has been folded open, the shape of the inner chamber should be more-or-less uniform. Using fold lines prepared in this way also reduces the force required to set up the box, which facilitates the folding-open or setting-up of the folding box.

First, rear wall element 43 is folded along fold line 42 toward second side wall element 41 in such a way that, as previously mentioned, if the element were to be folded completely over, the outer surfaces of the folding box would come to rest on each other. This therefore represents an "outward folding", i.e. a folding downward from the plane of the drawing. Then retaining tab 45 is folded at its free end along fold line 51 toward the inner side of the folding box blank and then folded along fold line 49 toward the outer surface of the blank, in both cases by approximately 90°. Then second side wall element 41 is folded along fold line 39 toward front wall element 35. Adhesive is then applied to the outer surface of the free end of retaining tab 45, and this free end of retaining tab 45 is glued to the corresponding section of front wall element 35. After folding along fold lines 34 and 31 toward the outer surface of the blank and after glue has been applied to the now outward-facing surface of the rear wall element 43, this element is glued to rear wall element 29, so that an essentially cuboid-shaped cavity, i.e., hollow inner chamber 5, is obtained.

Subsequently, outer packaging body 3 can be prepared so that the two main components of the folding box can be assembled. For this purpose, tab 21 is first bent over along fold lines 20 and 22 toward the inner surface of the folding box blank. Free end 23 is then bent along fold line 24 toward the outer surface of the folding box blank. Now the inside surface of free end 23 is glued to the surface of side wall 11, specifically in such a way that, after the gluing step, the distance between fold line 24 and fold line 18 is essentially the same as the distance between fold lines 20 and 22. It is preferable to adhere to these dimensions, because, when tab 21 is folded in parallelogram fashion, a cavity should be formed, which, when the folding box is closed, cooperates with inner chamber 5 in such a way that a product present inside inner chamber 5 can be supported against the cavity formed by tab 21.

Side wall 11 can now be folded toward front wall 7. As usual in the case of a conventional folding box, toward front wall 7 is movement toward the inside surface of the outer packaging body 3. After this "inward" folding, front wall 7 can be folded toward the other side wall 11, and then correspondingly the other side wall can be folded toward rear wall 9. After rear wall 9 has been folded along fold line 26 toward glue tab 25, and after glue has been applied to the outside surface of glue tab 25 and to the surfaces of front wall element 35 of the inner chamber which are facing the outside in relation to inner chamber 5, inner chamber 5 can now be glued to outer packaging body 3. Thus glue tab 25 is glued to the inner side of side wall 11, along its free long side, i.e. the free edge on the extreme right of the FIGURE. Similarly the outward-facing surfaces of front wall element 35 are glued to the inward-facing surface of front wall 7. In the exemplary embodiment shown here, first opening 37 and second opening 8 thus come to rest directly on or over each other.

In this state, the preferred embodiment of the box of the present invention is in the so-called "pre-fabricated" state. Specifically, in this state, the folding box is pressed flat, and its ends are open. The folding box manufacturer can now send the box to the customer, where it will be folded open, filled with one or more products, and closed.

With respect to the simple folding-open of the pre-fabricated folding box of the present invention, it can be seen, when looking from the bottom or from the top into the folding box, that a retaining web has been formed in the interior space of the inner chamber. The retaining web formed can hold a product of appropriate size in and within the inner chamber. A similar function is played by tab 21 at the top, which can be folded inward in parallelogram fashion toward the upper open end of inner chamber 5. Thus an elongated product present in inner chamber 5 can no longer fall out, provided that the cross sections at the end points of inner chamber 5 are of suitable dimensions. The further closing of the folding box takes place in the known manner by folding over top and bottom elements 13, 15, and by closing the box appropriately by inserting tab 17 into the provided slot.

Those skilled in the art will recognize that the variability of the present invention with respect to inner chamber 5 is provided due to the width of glue tab 25 and the freely selectable gluing of precisely one outer surface of inner chamber 5, i.e., either of front wall element 35 (as in the exemplary embodiment shown here) of side wall element 33 or 41, to the corresponding oppositely located inner surfaces of outer packaging body 3. Such construction allows inner chamber 5 to be positioned almost anywhere in the interior space of outer packaging body 3. Nevertheless, inner chamber 5 is always correctly folded in the pre-fabricated state. The minimum distances required for gluing in the case of the known folding boxes is eliminated. In the exemplary embodiments shown here, it can be seen that a product present in inner chamber 5 is enclosed by the printed, visually attractive outer side of blank 1 facing the product, not by the un-printed inner side of blank 1.

This means that both the outer side of outer packaging body 3 and the interior of inner chamber 5 (visible through first opening 37 and second opening 8) can be designed in a visually attractive manner as shown in FIG. 2.

With the inventive objects of the present invention, a folding box with an inner chamber is provided, including an inner chamber can be positioned variably at any location inside the internal volume of the outer packaging body without minimum distances, where only a minimum gluing surface area is required, and where a product present in the inner chamber is stored and held securely in a visually attractive manner.

Reference throughout this specification to "one embodiment," "an embodiment," a preferred embodiment" or similar language means that a particular feature, structure, or characteristic described in connection with the embodiment is included in at least one embodiment of the present invention. Thus, appearances of the phrases "in one embodiment," "in an embodiment," "in a preferred embodiment," and similar language throughout this specification may, but do not necessarily, all refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

While the present invention has been described in connection with certain exemplary or specific embodiments, it is to be understood that the invention is not limited to the disclosed embodiments, but, on the contrary, is intended to cover various modifications, alternatives, modifications and equivalent arrangements as will be apparent to those skilled in the art. Any such changes, modifications, alternatives, modifications, equivalents and the like may be made without departing from the spirit and scope of the invention.

What is claimed is:

1. A folding box for the storage and presentation of products, comprising:

an outer packaging body (3) with a front wall (7) a rear wall (9), at least two side walls (11), a top element (13), and a bottom element (15); and a hollow inner chamber (5) in the interior of the outer packaging body (3) of rectangular cross section, which is formed by a front wall element (35), a rear wall element (29, 43), and two side wall elements (33, 41), each having outer surfaces, and in which a product is securely held when the folding box is in a closed state;

wherein the folding box is formed out of a one-piece blank (1), which comprises an outer side and an inner side, and wherein the outer packaging body (3) and the inner chamber (5) are glued to each other;

wherein the width of the inner chamber (5) is less than the width of the outer packaging body (3), with the result that, between at least one side wall (11) in the interior of the outer packaging body (3) and at least one side wall element (33, 41) of the inner chamber, an empty space is formed;

wherein either part of the outer surface of the front wall element (35) or part of one outer surfaces of the of the two side wall elements (31, 41), is glued to only one of the inner surfaces of the outer packaging body (3); and wherein the inner chamber (5) is formed by folding the front wall element (35), the rear wall element (29, 43), and the side wall elements (33, 41) toward the outer side of the blank (1).

2. A folding box according to claim 1, wherein the outer packaging body (3) comprises a rectangular or polygonal cross section.

3. A folding box according to claim 1, wherein on the rear wall element (43) of the inner chamber (5), a retaining tab (45) is formed, which can be glued to the front wall element (35) in such a way that, in a folded-open state, a retaining web extending through the inner chamber (5) is formed.

4. A folding box according to claim 3, wherein the front wall element (35) of the inner chamber (5) comprises a first opening (37).

5. A folding box according to claim 4, wherein the front wall (7) of the outer packaging body (3) comprises a second opening (8).

6. A folding box according to claim 5, wherein at least parts of the first and second openings (37, 8) lie on top of each other in the folded-open state.

7. A folding box according to claim 1, wherein on the at least one side wall (11) of the outer packaging body (3), a tab (21) is formed, which comprises three parallel fold lines (20, 22, 24), wherein, in a folded state of the folding box, the tab (21) is folded in such a way that at least part of a free end (23) of the tab (21) is glued to the inner side of the side wall (11) in the interior of the outer packaging body, and as a result a cuboid-shaped cavity is formed, which cooperates with the inner chamber (5) in such a way that a product present in the inner chamber (5) is held therein.

8. A folding box according to claim 1, wherein the empty space between the at least one side wall (11) of the outer packaging body (3) and the at least one side wall surface (33, 41) of the inner chamber (5) is less than 8 mm.

* * * * *